United States Patent [19]

Cox

[11] 4,347,197

[45] Aug. 31, 1982

[54] WATER DISTRIBUTOR

[75] Inventor: Randolph B. Cox, Madison, Wis.

[73] Assignee: Research Products Corporation, Madison, Wis.

[21] Appl. No.: 148,775

[22] Filed: May 12, 1980

[51] Int. Cl.[3] ..... B01F 3/04

[52] U.S. Cl. ..... 261/106; 239/43; 239/49

[58] Field of Search ..... 261/106, 103; 239/37, 239/43, 44, 49

[56] References Cited

U.S. PATENT DOCUMENTS

| | | | |
|---|---|---|---|
| 1,023,063 | 4/1912 | Bassford | 261/106 |
| 1,107,455 | 8/1914 | Sintz | 261/103 |
| 1,576,745 | 3/1926 | Hanford | 239/49 |
| 1,815,864 | 7/1931 | Patrick | 261/106 |
| 2,356,757 | 8/1944 | Fleisher | 261/106 |
| 2,529,839 | 11/1950 | Garvey et al. | 261/106 |
| 2,670,941 | 3/1954 | Feinberg | 62/177 |
| 2,773,555 | 12/1956 | Pape | 55/193 |
| 2,911,056 | 11/1959 | Edel | 261/103 |
| 2,947,452 | 8/1960 | Frohmader et al. | 62/314 |
| 3,254,841 | 6/1966 | Loncker, Sr. | 239/43 |
| 3,284,068 | 11/1966 | Goettl | 261/97 |
| 3,612,033 | 10/1971 | Chilcoat | 261/106 |
| 3,625,491 | 2/1969 | Yokoi et al. | 261/106 |

*Primary Examiner*—Tim R. Miles

*Attorney, Agent, or Firm*—Andrus, Sceales, Starke & Sawall

[57] ABSTRACT

A water distributor is disposed above an air-liquid contact pad, and is supplied with water from a supply line. The water is received within an elongated enclosed chamber having at least one elongated corner in its lower portion. A floor portion of the chamber is formed of an imperferate slightly flexible wall disposed generally tangential to the corner. A screen is disposed on the inner surface of the floor portion and is manually adjusted to engage with the said corner in a line contact relationship to form a water flow restriction or gap. The chamber above the restriction is sealed. During each cycle of operation, as water initially flows into the chamber, a miniscus forms at the gap which prevents water discharge. As the chamber fills with water, the air thereabove is trapped and pressurized and, together with the pressure of the accumulating head of water, gradually increases the pressure on the miniscus. Eventually, the surface tension at the miniscus breaks, allowing the water to flow downwardly through the gap.

9 Claims, 9 Drawing Figures

WATER DISTRIBUTOR

U.S. PRIOR ART OF INTEREST

U.S. Pat. No. 1,107,455—Sintz—Aug. 18, 1914
U.S. Pat. No. 2,670,941—Feinberg—Mar. 2, 1954
U.S. Pat. No. 2,773,555—Pape—Dec. 11, 1956
U.S. Pat. No. 2,947,452—Frohmader et al—Aug. 2, 1960
U.S. Pat. No. 3,284,068—Goettl—Nov. 8, 1966.

BACKGROUND AND SUMMARY OF THE INVENTION

This invention relates to a water distributor and more particularly to a distributor for supplying a uniform flow of water to the top of an air-liquid contact pad used in air treatment devices, such as humidifiers and evaporative colors.

The invention is an improvement over the devices disclosed in the above-identified U.S. Pat. Nos. 2,947,452 and 3,284,068.

In U.S. Pat. No. 2,947,452, an open-topped distributor tray is disposed over the edge of a gas-liquid contact pad and is supplied with water from above through a suitable supply line. A plurality of openings in the bottom of the tray permit gravity flow of water therethrough and downwardly onto the pad. While this device has been commercially successful, it is subject to certain disadvantages. The area surrounding the openings will, in time, lime up, thus adversely affecting the desired water flow rate. Furthermore, the device may not provide an even distribution of water to the pad, especially if the tray is tilted from the horizontal. In addition, and with a given fixed water flow rate from the supply line, there is no means for adjusting the flow rate downwardly from the tray.

The U.S. Pat. No. 3,284,068 solves some of the aforementioned problems and utilizes a sponge disposed between two vertical plates having spaced horizontal ribs which are adjustable to compress the sponge therebetween in a flow restrictive manner. This device is subject to a number of disadvantages. The sponge is likely to disintegrate in time, requiring regular replacement. Furthermore, the sponge will also lime up, causing the restriction between the compressive ribs to be reduced. The only solution for this is to adjustably enlarge the space between the ribs.

The present invention solves all of the aforementioned problems and is based on a unique concept of water distribution which is self compensating for buildup of deposits.

In accordance with one aspect of the invention, the water from the supply line is received within an elongated enclosed chamber having at least one elongated corner in its lower portion. A floor portion of the chamber is formed of an imperferate slightly flexible wall disposed generally tangential to the corner. A screen is disposed on the inner surface of the floor portion and is manually adjustable to engage with the said corner in a line contact relationship to form a water flow restriction or gap.

In accordance with another aspect of the invention, the chamber above the restriction is essentially sealed. During each cycle of operation, as water initially flows into the chamber, a miniscus forms at the gap which prevents water discharge. As the chamber fills with water, the air thereabove is trapped and pressurized and, together with the pressure of the accumated head of water, gradually increases the pressure on the miniscus. Eventually, the surface tension at the miniscus breaks, allowing the water to flow downwardly through the gap.

In accordance with yet another asepct of the invention, the device is self-adjusting or self-compensating for buildup of deposits of lime or other minerals. As the deposits accumulate at the gap, the miniscus diminishes, requiring a greater head of water and a smaller but more highly pressurized volume of trapped air, before the surface tension is broken. Once broken, however, the water will again flow through the gap.

In accordance with a further aspect of the invention, water will be discharged from the distributor even if deposit buildup has completely closed the gap or if, by adjustment, the screen has been compressed to the point that the chamber floor portion engages the said chamber corner. Under such circumstances, line pressure will build up along the gap, causing the flexible chamber floor portion to flex outwardly away from the corner to reopen the channel for water flow.

In accordance with yet another aspect of the invention, when a pair of parallel spaced corners are disposed in the bottom of the chamber, the chamber floor portion may comprise an elongated inverted V-shaped member with the screen covering its upper surface. The member is adjustable relative to the corners by means of a plurality of bolts.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
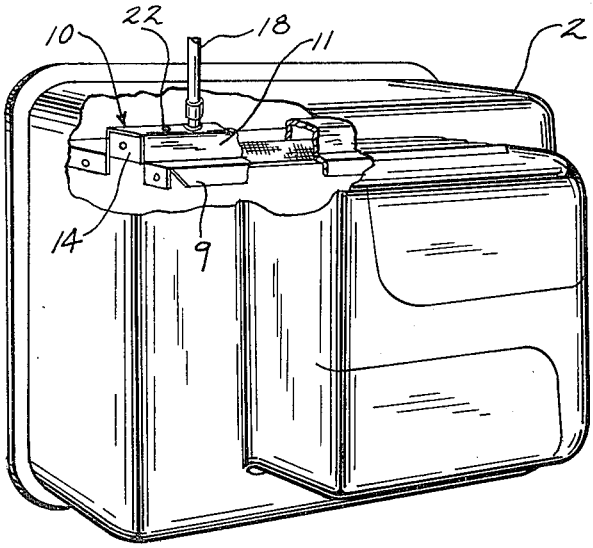
FIG. 1 is a perspective view of a humidifier adapted to incorporate the concepts of the invention.
Figure 2:
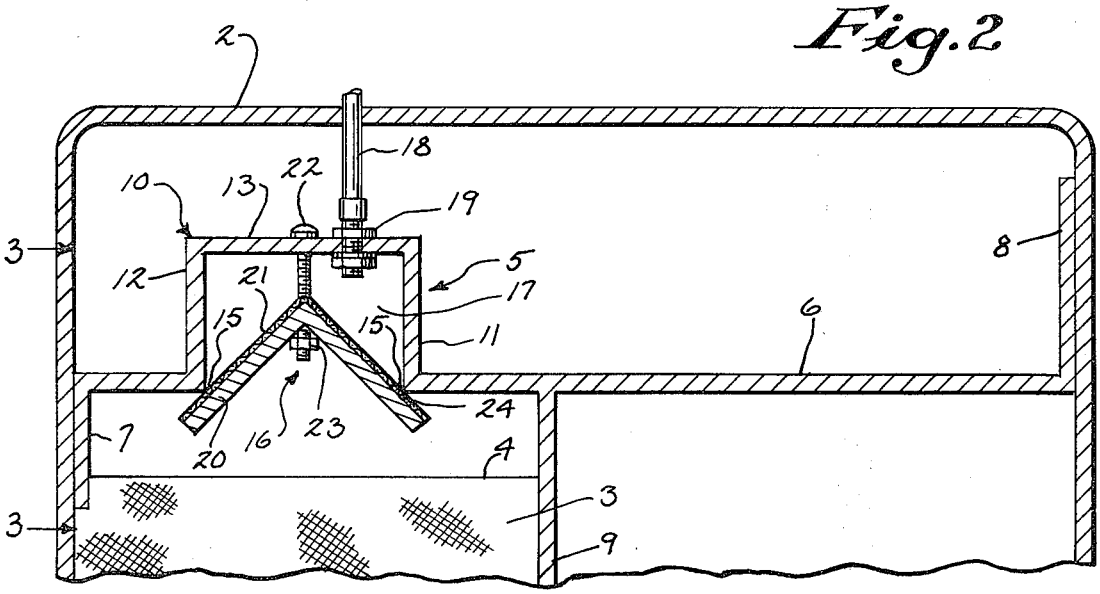
FIG. 2 is a transverse sectional view of a portion of the humidifier.
Figure 3:
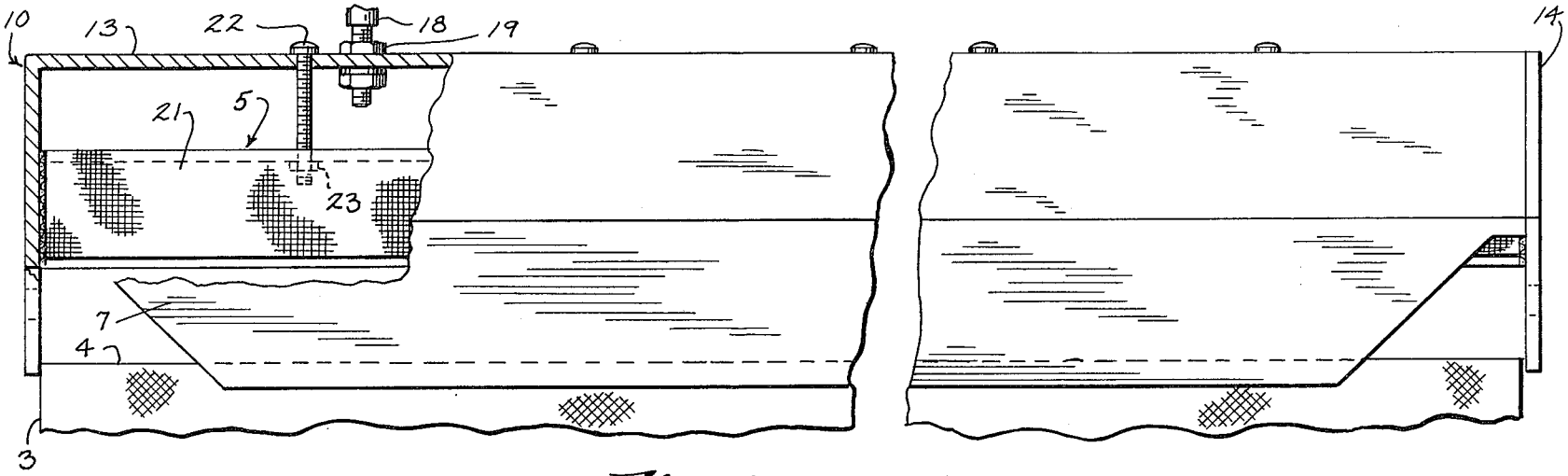
FIG. 3 is a sectional view taken on line 3—3 of FIG. 2.

Referring to FIGS. 1–3 of the drawings, the concepts of the invention may be embodied in an air treatment apparatus, such as a humidifier 1 having a housing 2 and an air-liquid contact pad 3 of any suitable well-known type mounted therein. A fan, not shown, is adapted to blow air through pad 3 where it contacts water flowing down through the pad. The water is supplied to the top edge 4 of pad 3 by the distributor 5 which forms the subject of the present invention.

Distributor 5 may be mounted within housing 2 by any suitable means. As shown, a horizontal platform 6 is disposed within housing 2 and is spaced from the top thereof. The rear of platform 6 is flanged downwardly as at 7 and the front of the platform is flanged upwardly as at 8, with the flanges engaging housing 2 and secured thereto if desired by any suitable means, not shown. A longitudinal flap 9 extends downwardly between flanges 7 and 8 and may assist in holding pad 3 in place.

In the area directly over pad 3, platform 6 is formed upwardly into an elongated distributor channel 10 having front and rear walls 11, 12 a top wall 13 and end walls 14. Distributor channel 10 is shown as integrally formed with platform 6, although it may be of separate construction. The channel is preferably made of a suitable extruded plastic such as PVC, and forms with platform 6 a pair of elongated horizontally spaced facing corners 15. Corners 15 are shown in the present embodiment as sharp edges, but they may be curved to at least some extent without departing from the spirit of the invention.

The walls of channel 10 cooperate with a flow control assembly 16 to form an enclosed elongated chamber 17 adapted to receive water through a supply line 18 which is sealingly connected into top wall 13 as by a fitting 19.

In the present embodiment, the flow control assembly 16 comprises an imperforate member 20 forming a floor of chamber 17 and which is co-extensive with channel 10 and adjacent and generally tangential to corners 15. Member 20 is shown in this embodiment as being of inverted V-shape with the walls thereof converging at about 90°. Member 20 is slightly flexible and is also preferably made of extruded plastic such as PVC. For purposes of precise flow control, a flexible screen 21 extends over and is backed by the upper surface of member 20 and is disposed between the latter and corners 15. Member 20 and screen 21 extend upwardly within channel 10 and with their lower free edge portions extending downwardly and outwardly below corners 15 externally of chamber 17.

Screen 21 is preferably of the so-called insect screening type with about an 18×16 mesh, and can be made of fiberglass.

Assembly 16 is held in position and is manually adjustable in a vertical direction by a plurality of bolts 22 which is spaced longitudinally along channel 10. Each bolt 22 extends downwardly through top wall 13 and through the upper corner of assembly 16, with a nut 23 disposed beneath the assembly so that the latter is suspended therefrom.

Figure 5:
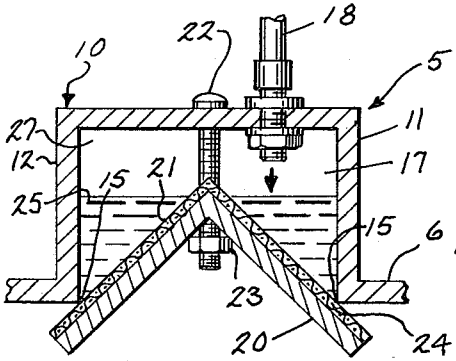
FIG. 5 is a full view of the chamber under the conditions shown in FIG. 4.

From desired operation of the distributor, and referring to FIGS. 2, 3 and 5, assembly 16 is confined between corners 15 and floor member 20 to form slit-like restrictions or gaps 24 wherein corners 15 and member 20 are spaced apart and in engagement with the screen. Screen 21 may be slightly compressed by these members.

The construction is such that water does not freely flow from chamber 17 through gaps 24, but rather normally requires pressurization from within the chamber. As water 25 flows into chamber 17 a miniscus 26 forms across screen 21 between each corner 15 and floor member 20. See FIG. 4. It has been found that screen 21 assists in formation of the miniscus so that water 25 is held back against the force of gravity and does not flow through gaps 24.

Figure 4:
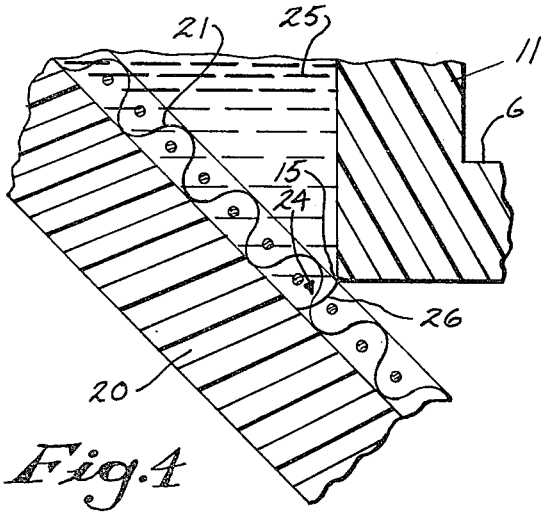
FIG. 4 is an enlarged fragmentary view showing a bottom corner of the chamber with the water held back by a miniscus.

FIG. 5 shows the full view of the distributor under the conditions of FIG. 4. As the water rises, and due to the construction wherein chamber 17 is sealed above gaps 24, a compressed air pocket 27 forms above water 25 with the air pressure in the pocket continuously increasing.

Figure 6:
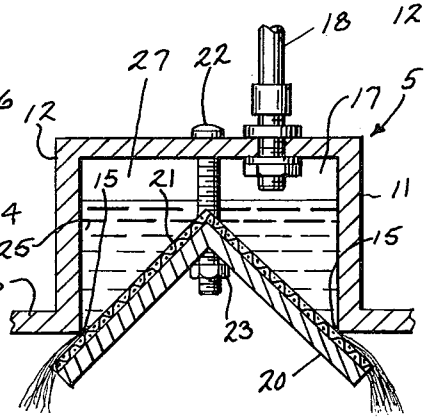
FIG. 6 is a view similar to FIG. 5 after the surface tension has been broken.

Finally, the pressure created at gaps 24 by the combination of (a) the heat of water in chamber 17 and (b) the air pocket pressure, will cause the surface tension at each minscus 26 to be broken. As shown in FIG. 6, water then discharges through gaps 24 and falls in a pair of curtain-like droplets or streams for engagement with pad 3. The pocket air pressure then decreases.

As in example, it may be desired to provide a water distribution rate of 7 gallons per minute per lineal foot of pad 3. The pressure and constant rate of water flow through line 18 is adjusted to provide that total amount of water. With gaps 24 set as in FIG. 4, it may take an effective chamber pressure of 1½" to break miniscus 26. When water 25 has risen 1", the air pocket pressure may be risen to an equivelant of an additional ½" of water pressure, at which point the miniscus breaks. The water will subsequently flow at the desired rate, not under line pressure, but under the chamber pressure. An equilibrium condition, such as that shown in FIG. 6, will continue as long as the flow rate through line 18 is unchanged.

Figure 7:
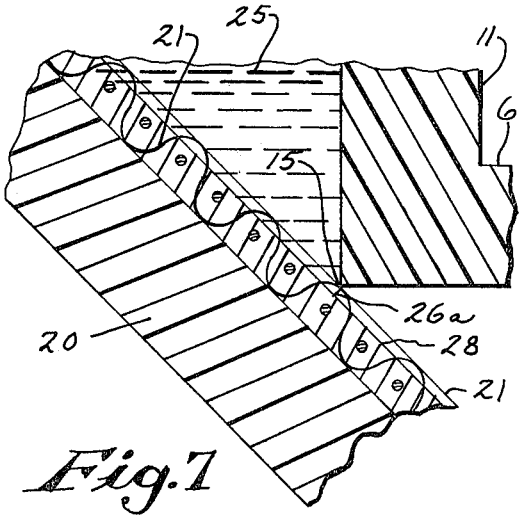
FIG. 7 is a view similar to FIG. 4 showing the buildup of minerals.
Figure 8:
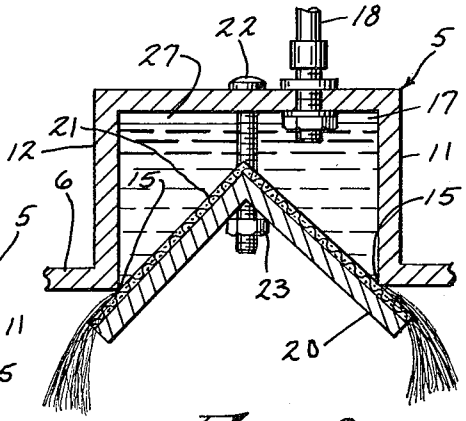
FIG. 8 is a full view of the chamber under the conditions shown in FIG. 7 and with the release of water.

The device of the invention is automatically self-adjusting and self-compensating for any buildup of deposits, such as lime or other minerals, without the need for manual adjustment of bolts 22. Referring to FIG. 7, and with the same setting as in FIG. 4, a buildup of deposits 28 has occured from floor wall 20 to near the upper portion of screen 21. The deposits may or may not be as uniform as is shown. When water 25 flows into the distributor, only a very small miniscus 26*a* forms between corners 15 and deposits 28. The diminished miniscus 26*a* will require substantially more chamber pressure from above before the surface tension breaks. Thus, and as shown in FIG. 8, the head of water 25 will be greater and air pocket 27 will be substantially more compressed before water is discharged out of the distributor. Once this happens, however, the system will perform just as in FIGS. 4–6.

Figure 9:
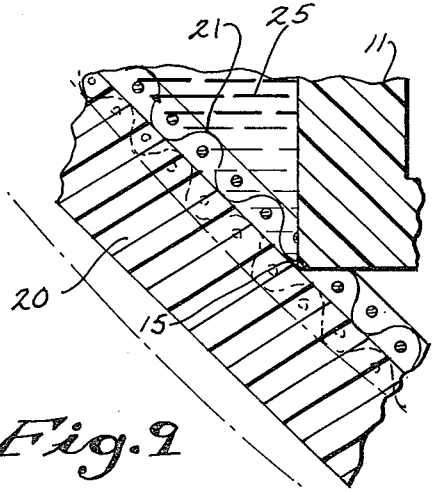
FIG. 9 is a view similar to FIG. 4 showing flexing of the chamber floor portion.

The distributor of the invention incorporates a feature which permits continued discharge of water even if gaps 24 are completely clogged by deposits, or if bolts 22 are accidentally adjusted so that corners 15 and floor member 20 are in tight line engagement with screen 21 substantially completely crushed therebetween. FIG. 9 illustrates the latter condition. As water flows into chamber 17, no miniscus forms. Water 25 will continue to rise until the chamber pressure at corners 15 has far exceeded the usual operative miniscus-breaking pressures. At this point, floor member 20, being flexible and having free edges closely adjacent and just below corners 15, is forced to flex away from the corners, as shown in phantom in FIG. 9. Screen 21 is carried with member 20. A gap is thus automatically provided through which the water will be discharged.

The concepts of the invention provide a unique and major improvement over previous water distributors. The device is relatively easy to manufacture, assemble, control and maintain.

While the present embodiment illustrates a pair of water flow restrictions or gaps 24 at the bottom of chamber 17, any other number of restrictions may be utilized without departing from the spirit of the invention. Also, the shape of floor member 20 may be other than V-shaped.

Various modes of carrying out the invention are contemplated as being within the scope of the following claims particularly pointing out and distinctly claiming the subject matter which is regarded as the invention.

I claim:

1. A distributor for the uniform supply of water from a water input line operating at line pressure to an extended area disposed therebeneath, said distributor comprising:

(a) means forming an elongated chamber adapted for connection with said water line, said chamber having at least one elongated restrictive gap disposed in its lower portion, (b) means disposed in said gap for causing the formation of a miniscus across said gap as water flows into said chamber from said water line, to thereby prevent water from flowing through said gap, (c) said chamber being enclosed and being generally sealed above said gap so that said chamber becomes pressurized below the said line pressure as water rises therein whereby said miniscus is ultimately broken by the rising pressure within said chamber to permit water to be discharged downwardly through said gap, (d) said gap being defined by:

(1) a corner disposed in a chamber wall, (2) and a flow control assembly disposed adjacent said corner and generally tangential thereto.

2. The distributor of claim 1 wherein the construction is such that as said water rises in said chamber, to form a pressurized water head, an air pocket is formed above the water which adds to the pressure of said water head on said miniscus.

3. The distributor of claim 1 wherein said flow control assembly comprises:

(a) an imperforate backing member, (b) and said miniscus forming means.

4. The distributor of claim 3 in which said miniscus forming means comprises a screen mounted on said backing member and facing said corner.

5. The distributor of claim 4 wherein buildup of deposits on said screen is automatically compensated for by a resultant diminishing of said miniscus and increased chamber pressure required to break said miniscus.

6. The distributor of claim 5 which includes means for manually adjusting said flow control assembly relative to said corner to thereby adjust the width of said gap.

7. The distributor of claim 6 wherein said flow control assembly is flexible and has a free edge portion disposed adjacent said corner so that in the event said gap is closed by said deposits or by said manual adjusting means, pressure within said chamber will cause said assembly to flex away from said corner to thereby open said gap.

8. The distributor of claim 3, 4, 5, 6 or 7 wherein:

(a) said chamber includes a pair of said corners with the corners being spaced horizontally and in facing relationship, (b) said flow control assembly is of inverted V-shape and extends upwardly into said chamber forming means to adjacent said corners, (c) and said assembly adjusting means comprises a plurality of bolts spaced along said chamber forming means and extending through the latter and said flow control assembly.

9. A distributor for the uniform supply of water from a water input line operating at line pressure to an extended area disposed therebeneath, said distributor comprising:

(a) means forming an elongated chamber adapted for connection with said water line, said chamber having at least one elongated restrictive gap disposed in its lower portion, (b) meand disposed in said gap for causing the formation of a miniscus across said gap as water flows into said chamber from said water line, to thereby prevent water from flowing through said gap, (c) said chamber being enclosed and being generally sealed above said gap, (d) said gap being defined by:

(1) a corner formed in a chamber wall, (2) and a flow control assembly disposed closely adjacent said corner, (e) said flow control assembly extending from within said chamber and past said corner to terminate outwardly beyond said corner in a free edge portion externally of the said chamber, said flow control assembly comprising:

(1) an imperforate backing member forming part of the means forming said chamber, (2) and said miniscus forming means, and with the latter being disposed between said corner and said backing member.

* * * * *

UNITED STATES PATENT AND TRADEMARK OFFICE

CERTIFICATE OF CORRECTION

PATENT NO. : 4,347,197

DATED : August 31, 1982

INVENTOR(S) : Randolph B. Cox

It is certified that error appears in the above-identified patent and that said Letters Patent is hereby corrected as shown below:

Column 1, Line 18, Delete "colors" and substitute therefor ----coolers----;

Column 3, Line 50, Delete "From" and substitute therefor ----For----;

Column 4, Line 11, Delete "in" and substitute therefor ----an----;

Column 4, Line 18, Delete "be" and substitute therefor ----have----;

Column 6, Line 27, Delete "meand" and substitute therefor ----means----.

Signed and Sealed this

*Seventh* Day of *December 1982*

[SEAL]

*Attest:*

GERALD J. MOSSINGHOFF

*Attesting Officer*

*Commissioner of Patents and Trademarks*